US010682563B2

(12) United States Patent
Yang

(10) Patent No.: US 10,682,563 B2
(45) Date of Patent: Jun. 16, 2020

(54) MULTI-DIRECTIONAL FLEXIBLE DYNAMICALLY ADJUSTABLE PROTECTION APPARATUS

(71) Applicant: Kyle Liou Yang, Weston, MA (US)

(72) Inventor: Kyle Liou Yang, Weston, MA (US)

( * ) Notice: Subject to any disclaimer, the term of this patent is extended or adjusted under 35 U.S.C. 154(b) by 71 days.

(21) Appl. No.: 16/067,417

(22) PCT Filed: Sep. 28, 2017

(86) PCT No.: PCT/US2017/054150
§ 371 (c)(1),
(2) Date: Jun. 29, 2018

(87) PCT Pub. No.: WO2018/064406
PCT Pub. Date: Apr. 5, 2018

(65) Prior Publication Data
US 2019/0151744 A1 May 23, 2019

(51) Int. Cl.
*A63B 71/12* (2006.01)
*A41D 13/015* (2006.01)
*A41D 13/05* (2006.01)

(52) U.S. Cl.
CPC ..... *A63B 71/1216* (2013.01); *A41D 13/015* (2013.01); *A41D 13/05* (2013.01); *A41D 13/0568* (2013.01); *A41D 13/0525* (2013.01); *A41D 13/0537* (2013.01); *A41D 2600/10* (2013.01); *A63B 2071/1208* (2013.01); *A63B 2209/10* (2013.01)

(58) Field of Classification Search
CPC .. A41D 13/015; A41D 13/05; A41D 13/0568; A41D 13/0525; A41D 13/0537; A41D 2600/10; A63B 71/1216; A63B 2209/10
USPC ..... 2/466
See application file for complete search history.

(56) References Cited

U.S. PATENT DOCUMENTS 1,019,501 A * 3/1912 Love ..... A61F 5/24 128/100.1
4,922,860 A * 5/1990 Hutchings ..... A01K 27/002 294/140
5,020,547 A * 6/1991 Strock ..... A41D 13/0506 128/891
7,296,307 B2 * 11/2007 Atwater ..... A63B 71/12 128/846
8,181,271 B2 * 5/2012 Sasaki ..... A41D 13/065 2/24
8,245,327 B2 * 8/2012 Wilson, II ..... A41D 13/0506 2/466
8,808,216 B2 * 8/2014 Diamond ..... A61F 5/40 602/67
9,642,402 B1 * 5/2017 Scherr ..... A41D 13/0537
9,877,524 B1 * 1/2018 Kaviani ..... A41D 1/084
2005/0251895 A1 * 11/2005 Farrah ..... A41D 1/08 2/227
2015/0018744 A1 * 1/2015 Reed ..... A41B 9/12 602/72

(Continued)

*Primary Examiner* — Khaled Annis
*Assistant Examiner* — Dakota Marin
(74) *Attorney, Agent, or Firm* — Bennet K. Langlotz; Langlotz Patent & Trademark Works, LLC

(57) ABSTRACT

A novel multi-directional flexible dynamically adjustable protection apparatus for use in protecting a user in a manner which provides relief from mechanical forces via both direct impact and mechanical forces when the user moves.

13 Claims, 16 Drawing Sheets

(56) References Cited

U.S. PATENT DOCUMENTS

2018/0213857 A1* 8/2018 Miller ..... A41D 13/065

* cited by examiner

100

200

300

600

600

FIGURE 7a
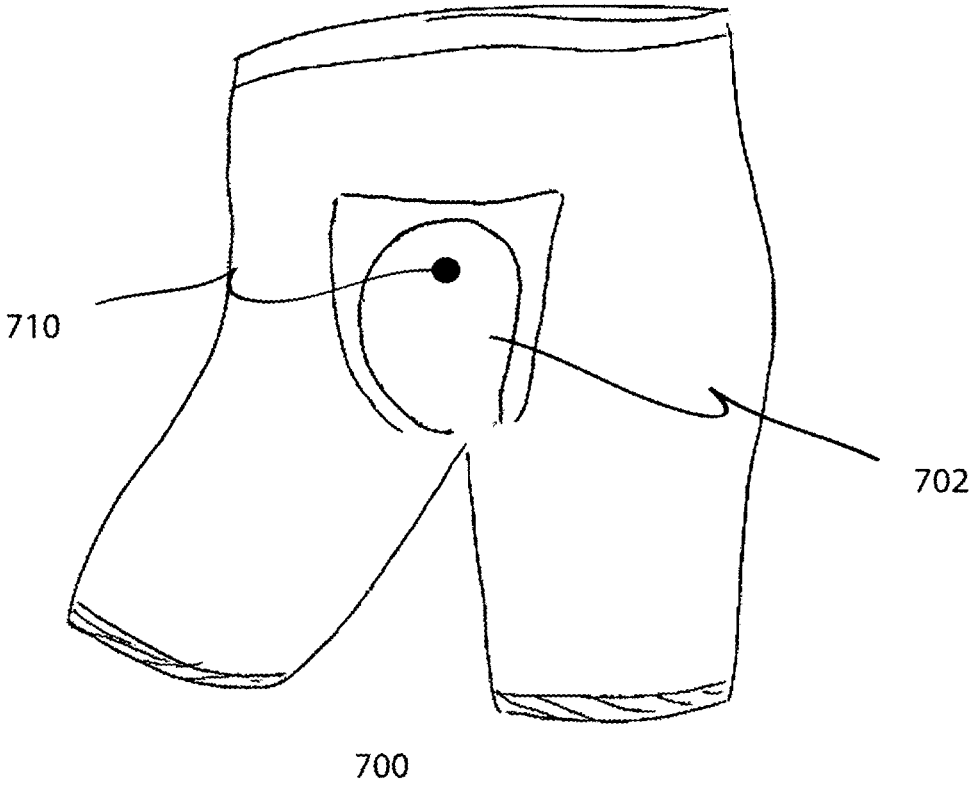
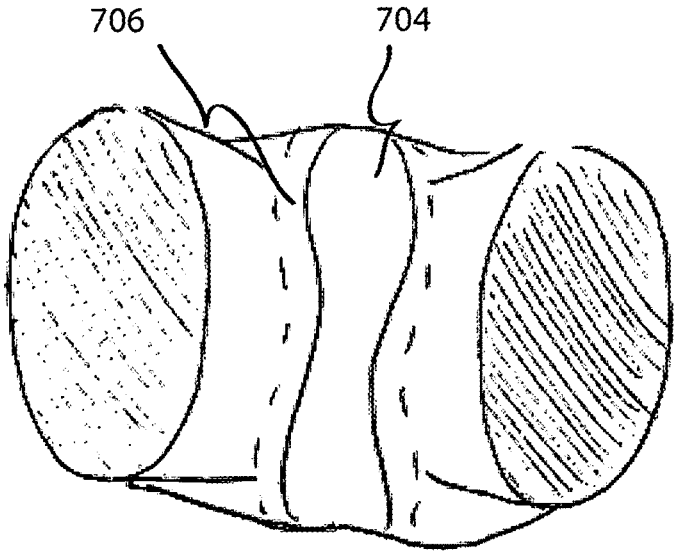
FIGURE 7b
700

Figure 10a
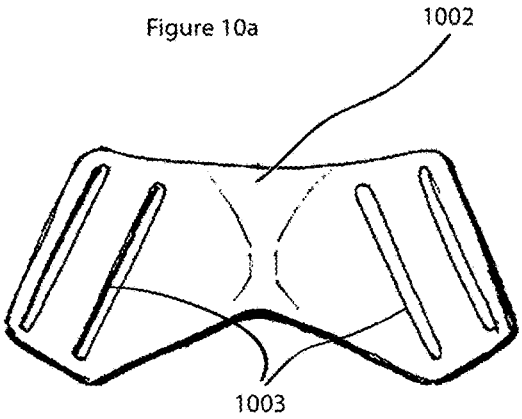
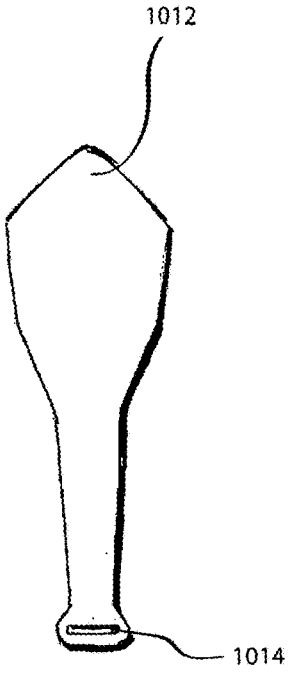
Figure 10b
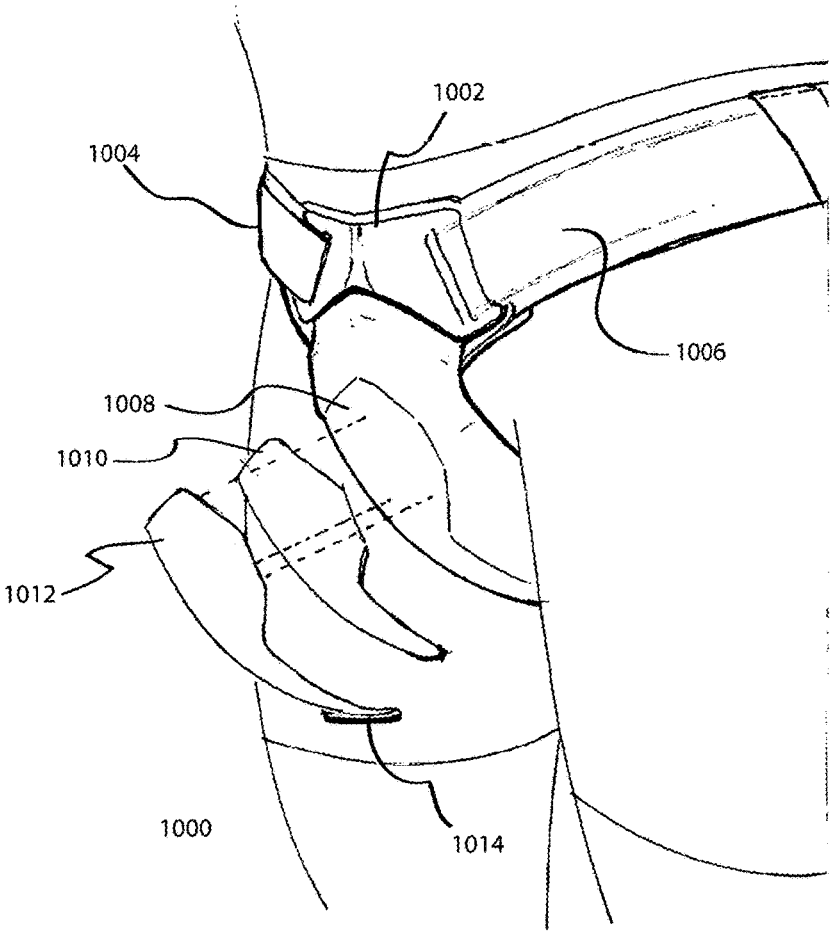
Figure 10c

MULTI-DIRECTIONAL FLEXIBLE DYNAMICALLY ADJUSTABLE PROTECTION APPARATUS

This United States non provisional national phase patent application claims the benefit of priority to earlier filed Patent Cooperation Treaty Patent Application entitled, A MULTI-DIRECTIONAL FLEXIBLE DYNAMICALLY ADJUSTABLE PROTECTION APPARATUS, filed Sep. 28, 2017, having serial number PCT/US2017/054150, which in turn claims the benefit of priority to earlier filed United States Provisional Patent Application filed on Sep. 28, 2016 entitled, "ATHLETIC CUP APPARATUS", to Yang, having Ser. No. 62/400,833, both of which are hereby incorporated by reference in their entirety to the extent not inconsistent with this disclosure.

BACKGROUND

Field

The present invention relates generally to an undergarment, which provides protection against direct mechanical impact while allowing for maximum lateral motion without discomfort or pain.

Related Art

Protective cups have long been used in sporting activities to protect the groin from impact and for general support. Undergarments have often been configured to hold such protective cup in place.

Although undergarments and protective cups are generally effective, shortfalls exist. For example, combat sports often expose the wearer to upward blows to the groin areas. Current configurations tend to provide minimal protection for such blows. When current configurations are exposed to an upward blow, the protective cup can become dislodged from its required location. Instead, the protective cup can move within the pocket, moving relative to the groin of the wearer. As a result, the wearer can be exposed to substantial force in the groin area, risking serious injury. It should be appreciated that there remains a need for an undergarment and protective cup assembly that addresses these concerns. The present teachings solve these problems, as will now be described.

BRIEF DESCRIPTION OF THE DRAWINGS

Embodiments of the present disclosure will be more readily understood by reference to the following figures, in which like reference numbers and designations indicate like elements.

FIG. 7*a* illustrates a front plan view of an inflatable cycling short, according to one embodiment of the present teachings.

FIG. 7*b* illustrates a bottom plan view of an inflatable cycling short, according to one embodiment of the present teachings.

FIG. 10*a* is a front plan view of a front affixing portion of a multi-directional flexible dynamically adjustable protection apparatus, according to one embodiment of the present teachings.

FIG. 10*b* is a top plan view of an outer shell having a slit element of a multi-directional flexible dynamically adjustable protection apparatus, according to one embodiment of the present teachings.

FIG. 10*c* is an exploded view of a cup assembly and partial view of a belt assembly of a multi-directional flexible dynamically adjustable protection apparatus, according to one embodiment of the present teachings.

DETAILED DESCRIPTION

Overview

The present teachings provide a multi-directional flexible dynamically adjustable protection apparatus for increased protection from direct impact to a sensitive region of the human body and general support to sensitive regions of the body. It will be appreciated that both human male and/or female users may benefit from the increased level of impact shock protection and improved range of movement provided by the present disclosure. Moreover, as will described further below, the apparatus of the present teachings may also be used for male genital support for athletic endeavors such as for example running, wherein lack of support can lead to discomfort and/or injury. However, embodiments of the present teachings will be useful in applications for athletic protection, body position management, military protective wear, and construction protective wear. Some disclosed embodiments use an inflatable bladder, whereas other embodiments use strain relief elements, which are rigid and protect against mechanical impact while providing excellent mobility and freedom of movement to the user.

Figure 1:
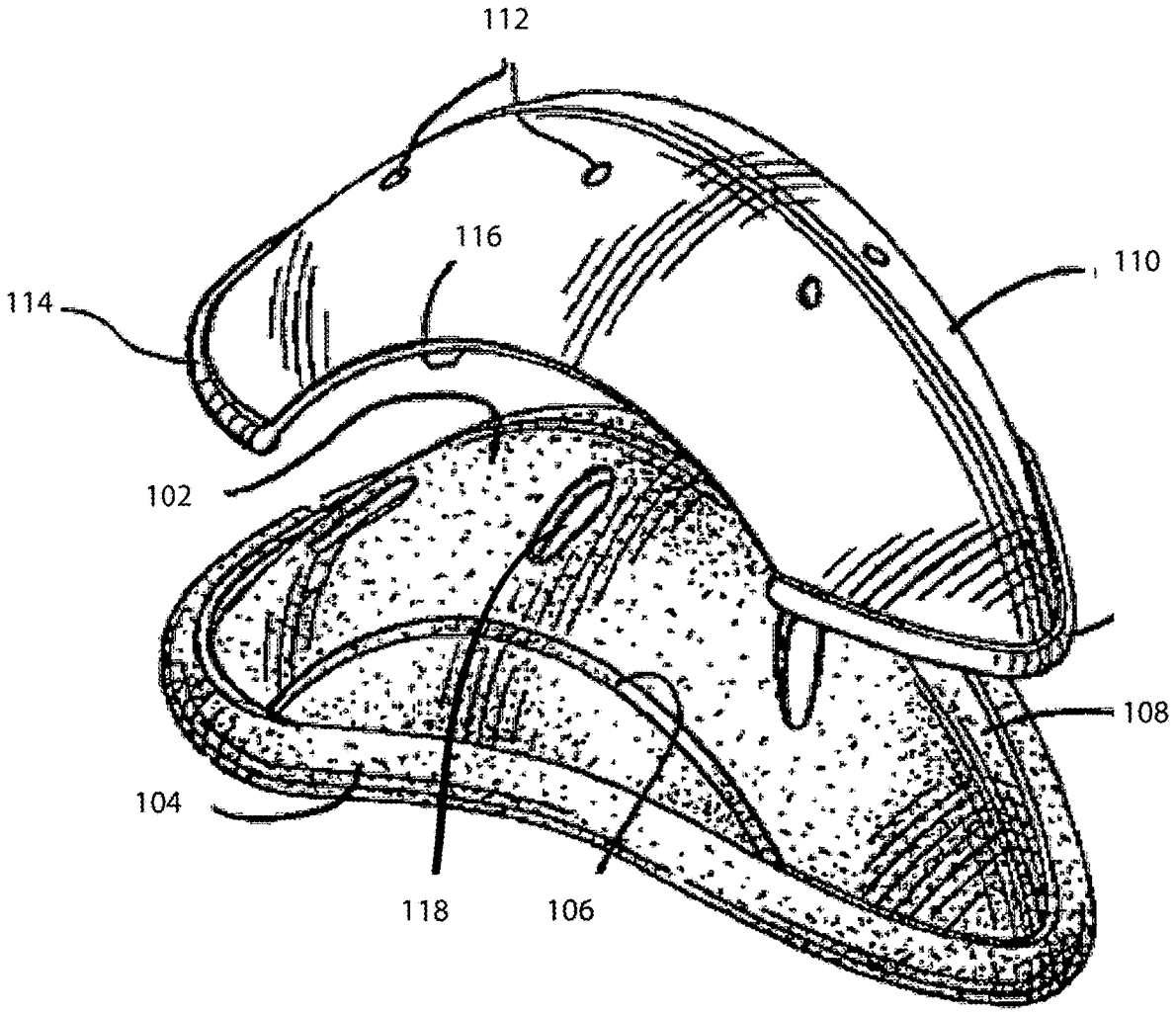
FIG. 1 illustrates an exploded view of an inflatable multi-directional flexible dynamically adjustable protection apparatus, according to one embodiment of the present teachings.

Referring now generally to FIG. 1, an inflatable multi-directional flexible dynamically adjustable protection apparatus 100 is disclosed. In one embodiment the inflatable multi-directional flexible dynamically adjustable protection apparatus 100 generally comprises a protective plate member 110 and an posterior air bladder 102. The posterior air bladder 102 is adapted to be disposed in a form-fitting manner posterior to the protective plate member 110. Both the posterior air bladder 102 and the protective plate member 110 have a generally convex shape, allowing for a user's genitalia to fit snugly therein. It will be appreciated that the protective plate member 110 provides a rigid "shell" to protect the user's genitalia from impact, as is commonly used in modern, state of the art athletic cups. However, the present teachings disclose the posterior air bladder 102 adapted to be customizably inflated by the user to a comfortable pressure, which is important for comfort and fit as not every user's body is shaped identically. For example, the inflatable multi-directional flexible dynamically adjustable protection 100 may be used by athletes, such as for example football, baseball, basketball, hockey, soccer players who may experience sudden and painful impact to the groin region of the human body. Modern athletic cups are limited to rigid, "one size fits all" devices, which may operate to deflect sudden impact but may be uncomfortable and lack form fitting design. Due to the inherent variable nature of the inflatable multi-directional flexible dynamically adjustable protection 100, a user may increase air pressure filling the posterior air bladder 102 such that a user customizable fit is achieved. Moreover, the additional layer of an "air cushion" behind the protective plate member 110 functions to provide impact shock absorbing structure, minimizing potentially painful injuries.

In addition to providing additional shock absorbing characteristics, it will be appreciated that the inflatable multi-directional flexible dynamically adjustable protection apparatus 100 may also provide support currently lacking in modern state-of-the-art devices. For example, male runners often will use a "jock strap" apparatus to hold their genitals still with respect to the body for comfort during a run. Such jock straps can be uncomfortable and are not adjustable for different body types. The present teachings provide a solution that is adjustable, because a user may readily customize pressure within the inflatable multi-directional flexible dynamically adjustable protection apparatus 100 to a comfortable volume.

As shown in FIG. 1, in one embodiment, the inflatable multi-directional flexible dynamically adjustable protection apparatus 100 comprises at least one vent port 118 disposed on the posterior air bladder 102, which is adapted to allow air flow between the user's body and external air. In this embodiment, the protective plate member 110 comprises at least one vent hole 112, adapted to align with the at least one vent port 118, such that the user's genitals have access to air for cooling and ventilation purposes. In one variation of the aforementioned embodiment, a tapered edge 104 disposed on an outward edge of the posterior air bladder 102 is disclosed. The tapered edge 104 generally comprises a rounded padding, adapted for comfort of a user and is shaped to conform to the curvature of the portion of a body where the thigh intersects the genital region. In this embodiment, a conforming region 116 disposed on an edge of the protective plate member 110 is adapted to fit seamlessly into the tapered edge 104 such that a snug fit is achieved. In one variation of the present teachings, an inflatable retaining element 106 is disclosed, disposed along a curvature of the posterior air bladder 102, and functions to provide a retention framing operating to keep the posterior air bladder 102 in place to avoid discomfort to the user from potential movement and shifting of the posterior air bladder 102. The inflatable retaining element 106 may be rigid or semi-rigid and also function to provide structure to the posterior air bladder 102.

Figure 2:
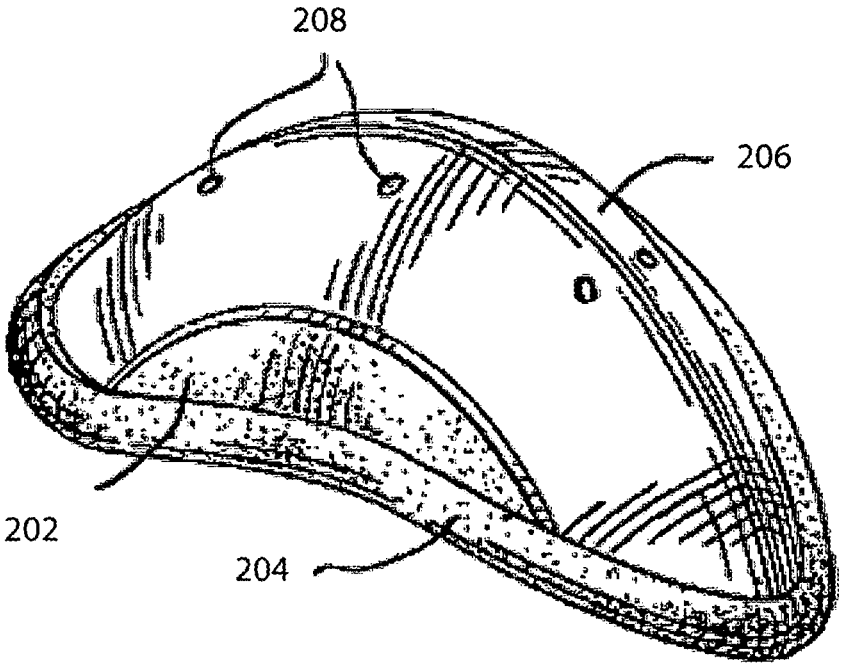
FIG. 2 illustrates perspective view of an inflatable multi-directional flexible dynamically adjustable protection apparatus, according to one embodiment of the present teachings.

Referring now to FIG. 2, an inflatable multi-directional flexible dynamically adjustable protection apparatus 200 is illustrated, comprising a posterior air bladder 202 operatively coupled to a protective plate member 206. The inflatable multi-directional flexible dynamically adjustable protection apparatus 200 comprises at least one vent hole 208, adapted to provide ventilation from an interior portion of the inflatable multi-directional flexible dynamically adjustable protection apparatus 200 to an exterior portion to help ventilate a user's genital region. A tapered edge 204 is adapted to provide a snug fit between the inflatable multi-directional flexible dynamically adjustable protection apparatus 200 and a user's body.

Figure 3:
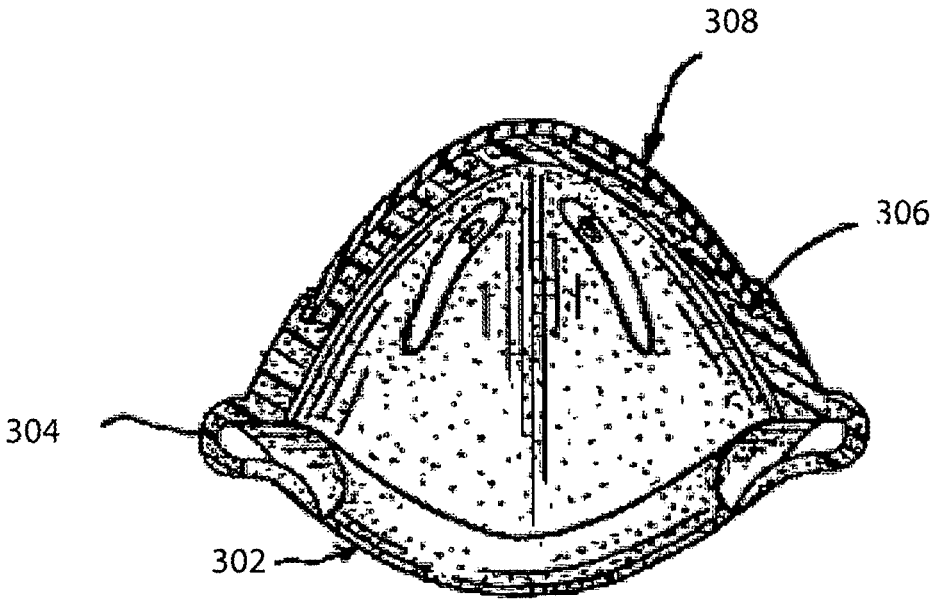
FIG. 3 illustrates a cross sectional view of an inflatable multi-directional flexible dynamically adjustable protection apparatus, according to one embodiment of the present teachings.

Referring now to FIG. 3, a cross sectional view of an inflatable multi-directional flexible dynamically adjustable protection apparatus 300 is illustrated, generally comprising a posterior air bladder 302 and a protective plate member 308. A tapered edge 304 provides a comfortable fit between the inflatable multi-directional flexible dynamically adjustable protection apparatus 300 and a user's body. An inflatable retaining element 306 extends along a longitudinal axis of the inflatable multi-directional flexible dynamically adjustable protection apparatus 300 and operates to provide a retention framing keeping the posterior air bladder 302 properly shaped and in place.

Figure 4:
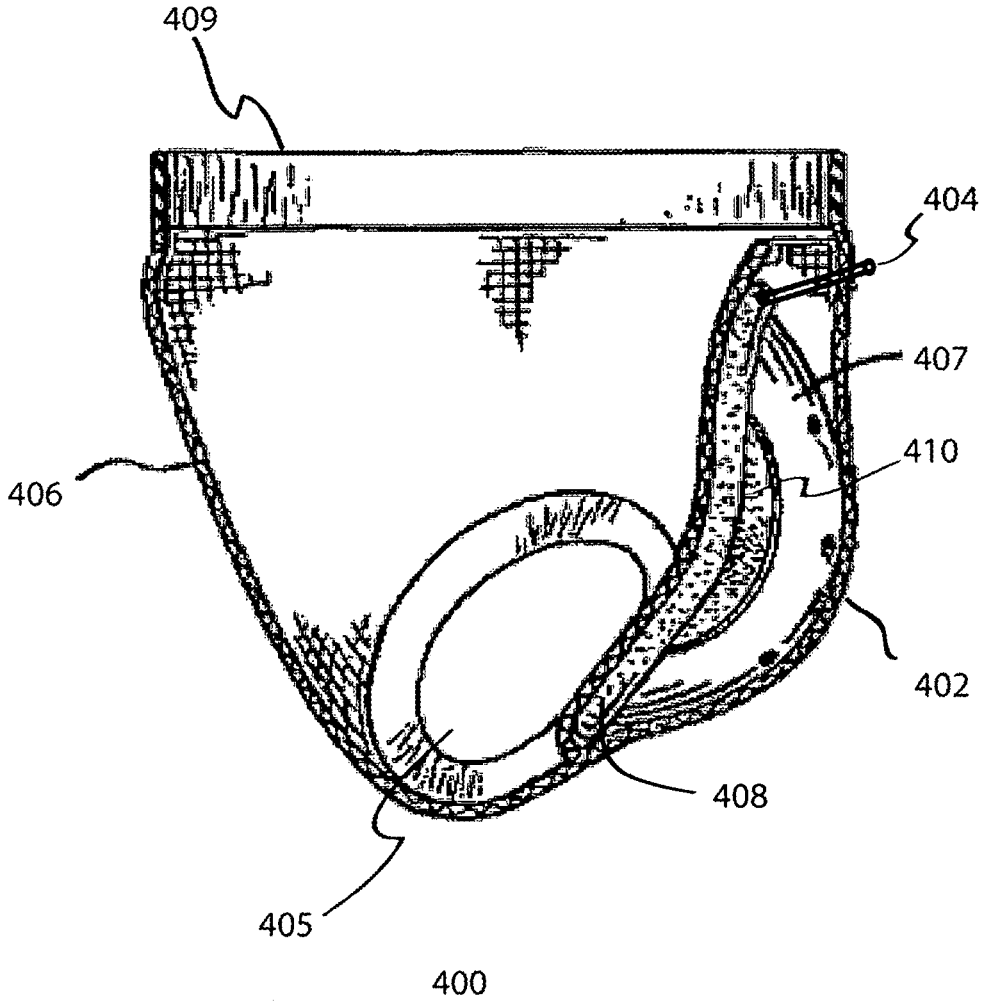
FIG. 4 illustrates a side plan view of an inflatable multi-directional flexible dynamically adjustable protection apparatus, according to one embodiment of the present teachings.

Referring now to FIG. 4, a mounted inflatable multi-directional flexible dynamically adjustable protection apparatus 400 is illustrated, generally comprising a pants undergarment 406 and an inflatable athletic cup apparatus 402. It will be appreciated that in this embodiment, the inflatable cup apparatus 402 is affixed to the underpants garment 406, wherein the inflatable cup apparatus 402 may be removable or non removable. In this configuration, the inflatable cup apparatus 402 further comprises an inflation aperture 404. The inflation aperture 404 may have a bellows disposed therein, which a user may operate to manually inflate a posterior air bladder 410, via a pumping action. Therefore, a user may inflate the inflatable cup apparatus 402 to a desired pressure for additional shock protection and/or support. It will be appreciated that an external air source (not shown) may be used in conjunction with the inflation aperture 404 to inflate the posterior air bladder 410. A tapered edge 408 provides a comfortable fit between the inflatable multi-directional flexible dynamically adjustable protection apparatus 400 and a user's body. The underpants garment 406 further provides a pair of leg apertures, adapted to allow a human leg therethrough. A waistband 409 functions to provide support about a user's waist to keep the underpants garment 406 fitting snugly about the waist.

Figure 5:
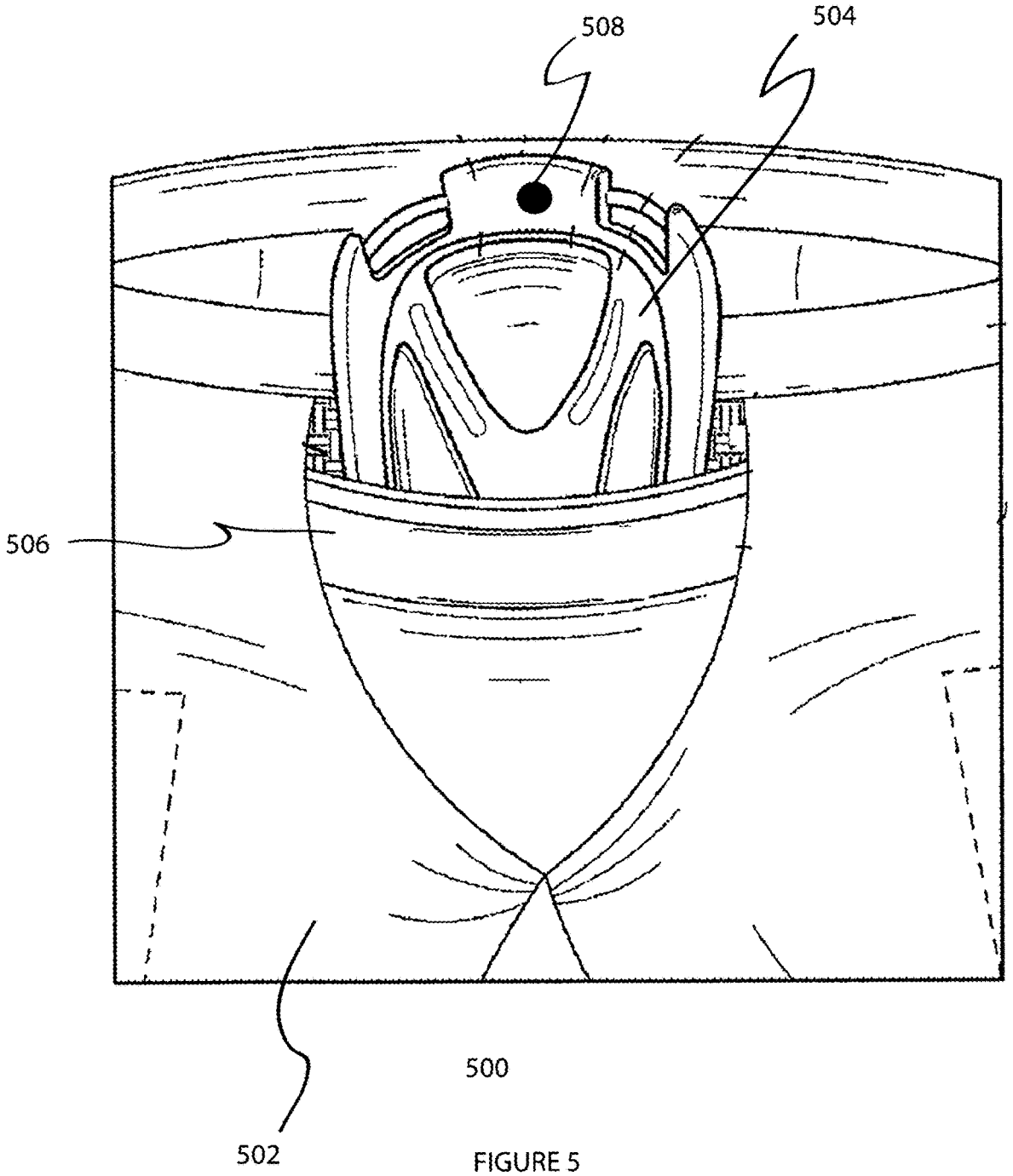
FIG. 5 illustrates a front plan view of an underpants garment apparatus, according to one embodiment of the present teachings.

FIG. 5 illustrates a front plan view of an underpants garment 502 having a front panel 506, adapted to allow an inflatable cup apparatus 504 to be inserted therein. In one embodiment, the inflatable cup apparatus 504 is not removable once inserted into the front panel 506. In one variation, the inflatable cup apparatus 504 is adapted to be removable from the underpants garment 502, when such additional support/protection is no longer required by the user. The inflation aperture 508 may have a bellows disposed therein, where a user may inflate the posterior air bladder to a desired pressure by actuating the bellows. In one variation, an external air source may be used for inflating the posterior air bladder via the inflation aperture 508.

It will be appreciated that women are increasingly participating in full contact sports such as for example boxing and mixed martial arts, where women can sustain painful and potentially harmful impact from strikes such as punches or kicks. Embodiments of the previously described teachings may be readily adapted for women to conform to and provide protection to a woman's genitalia.

Figure 6A:
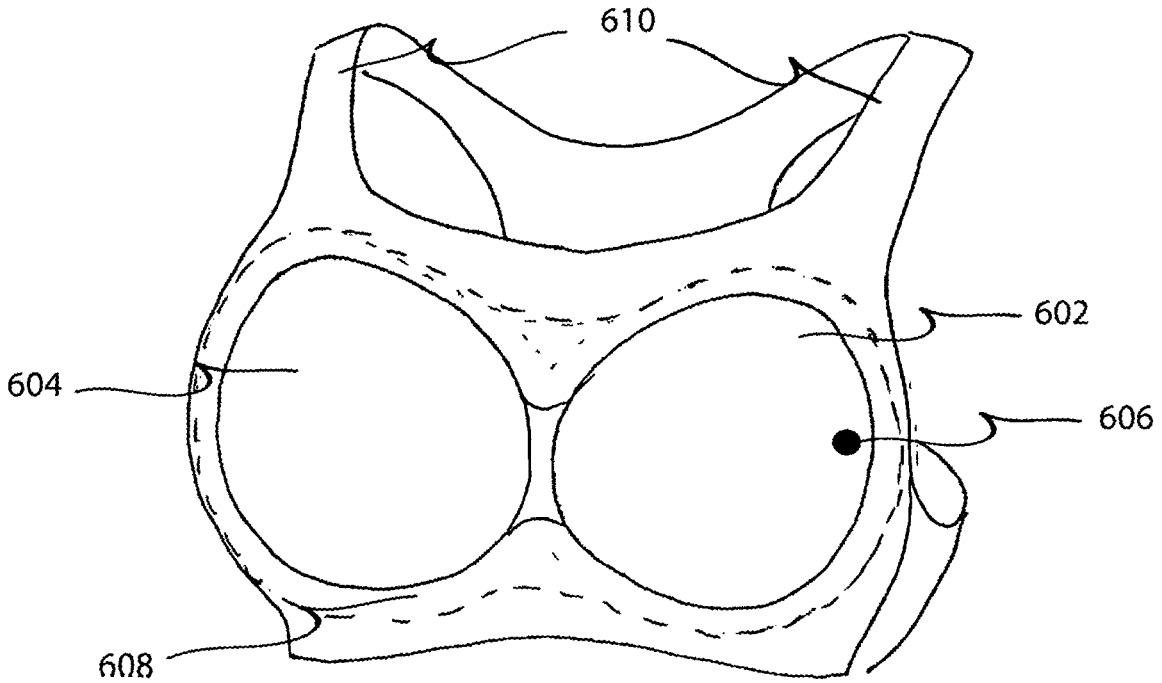
FIG. 6*a* illustrates a front plan view of a woman's inflatable woman's breast protection apparatus, according to one embodiment of the present teachings.
Figure 6B:
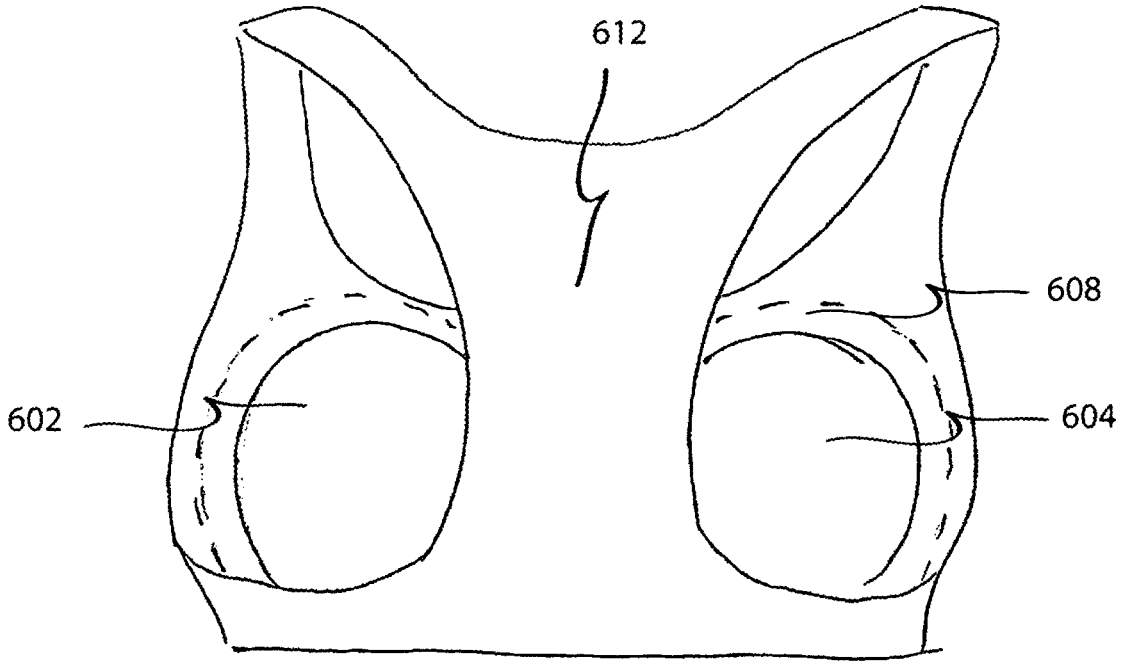
FIG. 6*b* illustrates a rear plan view of a woman's inflatable woman's breast protection apparatus, according to one embodiment of the present teachings.

Referring now to FIGS. 6*a* and 6*b*, in one embodiment of the present teachings, a woman's breast protection apparatus 600, is illustrated. In this variation, similar structure and function is provided, consistent with the previously described embodiments, but adapted for use by a woman to protect her breasts from potentially harmful impact. The woman's breast protection apparatus 600 generally comprises a left protective plate member 602, a right protective plate member 604, a shoulder strap 610, a back strap 612, an inflation aperture 606, and a posterior air bladder 608. The protective plate members 602 and 604 generally comprise a plastic, rigid shell designed to protect the soft breast tissue from physical striking of an opponent. It will be appreciated that the inflation aperture 606 functions in a manner similar to previously described embodiments, wherein a user may inflate the posterior air bladder 608 to provide a softer cushion to protect the breast tissue. The posterior air bladder 608 is disposed on a posterior side of the protective plate members 602 and 604. In one variation, an external air source may be used for inflating the posterior air bladder 608 via the inflation aperture 606.

Although described embodiments have suggested that the present teachings may be used to protect delicate portions of the body from direct physical impact in sporting events, some variations of the present disclosure may be readily adapted exclusively for support instead of impact protection, without departing from the spirit and scope of the invention. For example persons who walk, jog or run for recreational and/or competitive purposes will appreciate that an inflatable undergarment would be useful to provide support for male genitals or female breasts, which can move uncomfortably during running or other such endeavors, such as soccer. In these variations, the protective plate member may or may not be used, depending on the desires of the user.

Referring now to FIGS. 7*a* and 7*b*, a cycling short fitted garment 700 is disclosed. The cycling short fitted garment 700 generally comprises an inflation aperture 710, a padded front panel 702, a padded under panel 704, and a contoured inflatable underbadder 706. In one embodiment, the contoured inflatable underbladder 706 comprises two longitudinal inflatable bladders, extending from front to back along the sides the perineum to support this area when a user is seated on a bicycle seat. It will be appreciated by cycling enthusiasts that modern bicycle shorts are not generally very comfortable due to the large amount of padding in the crotch region of the shorts. The present teachings provide a solution for this problem by eliminating most of the padding and replacing the padding with two longitudinal air bladders, which function to provide support to the prostate and perineum by elevating this region of the body via the longitudinal air bladders. Because the longitudinal air bladders are inflatable as described above with respect to the other embodiments, a user can customizably inflate the cycling short fitted garment 700 to a comfortable pressure for their particular body. The cycling short fitted garment 700 is superior to current state of the art cycling shorts, because each person's body is different, yet modern cycling shorts have the same padding for every individual.

Figure 8A:
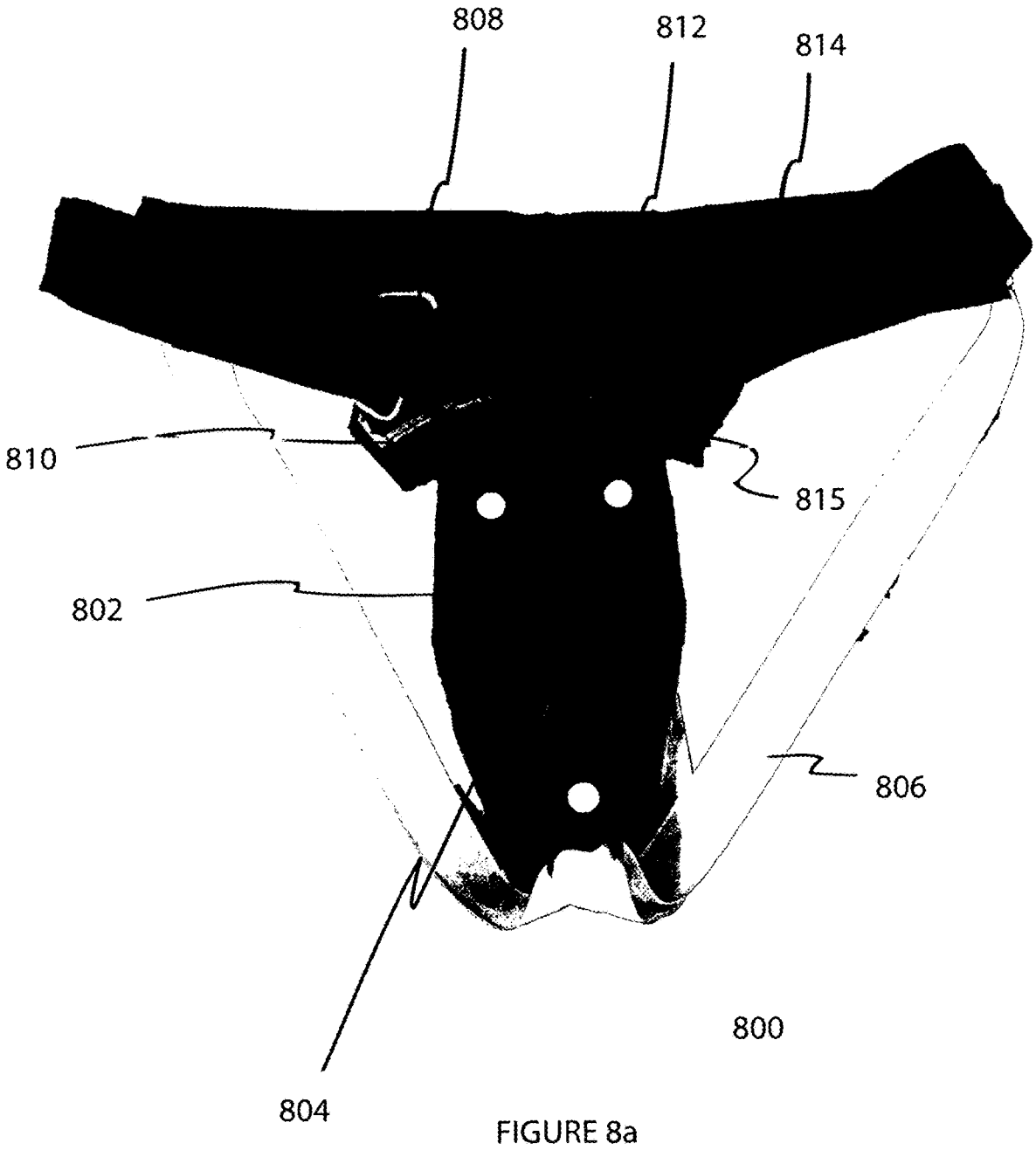
FIG. 8*a* illustrates a front plan view of an assembled multi-directional flexible dynamically adjustable protection apparatus, according to one embodiment of the present teachings.
Figure 8B:
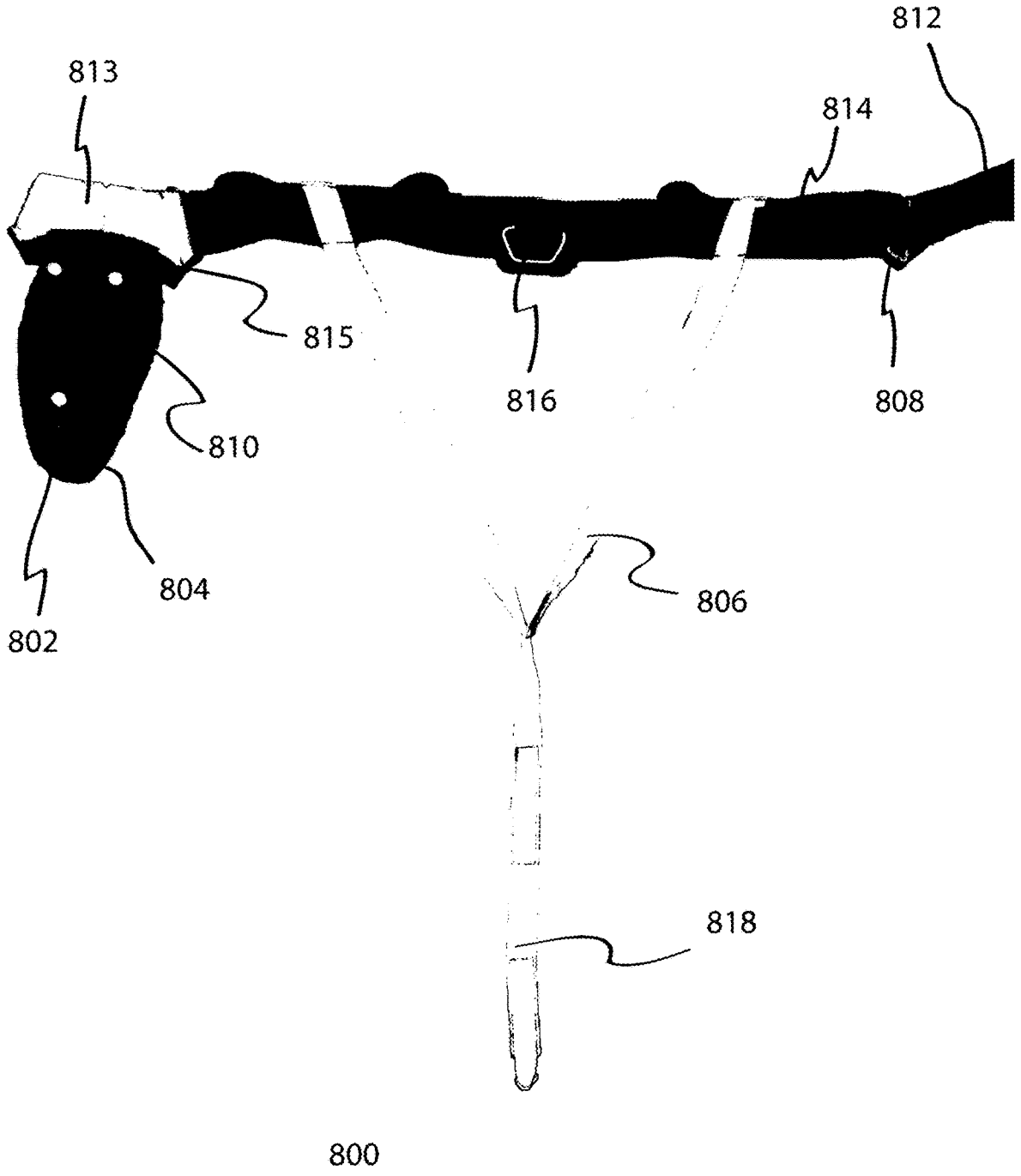
FIG. 8*b* illustrates a disassembled view of an assembled multi-directional flexible dynamically adjustable protection apparatus, according to one embodiment of the present teachings.
Figure 8C:
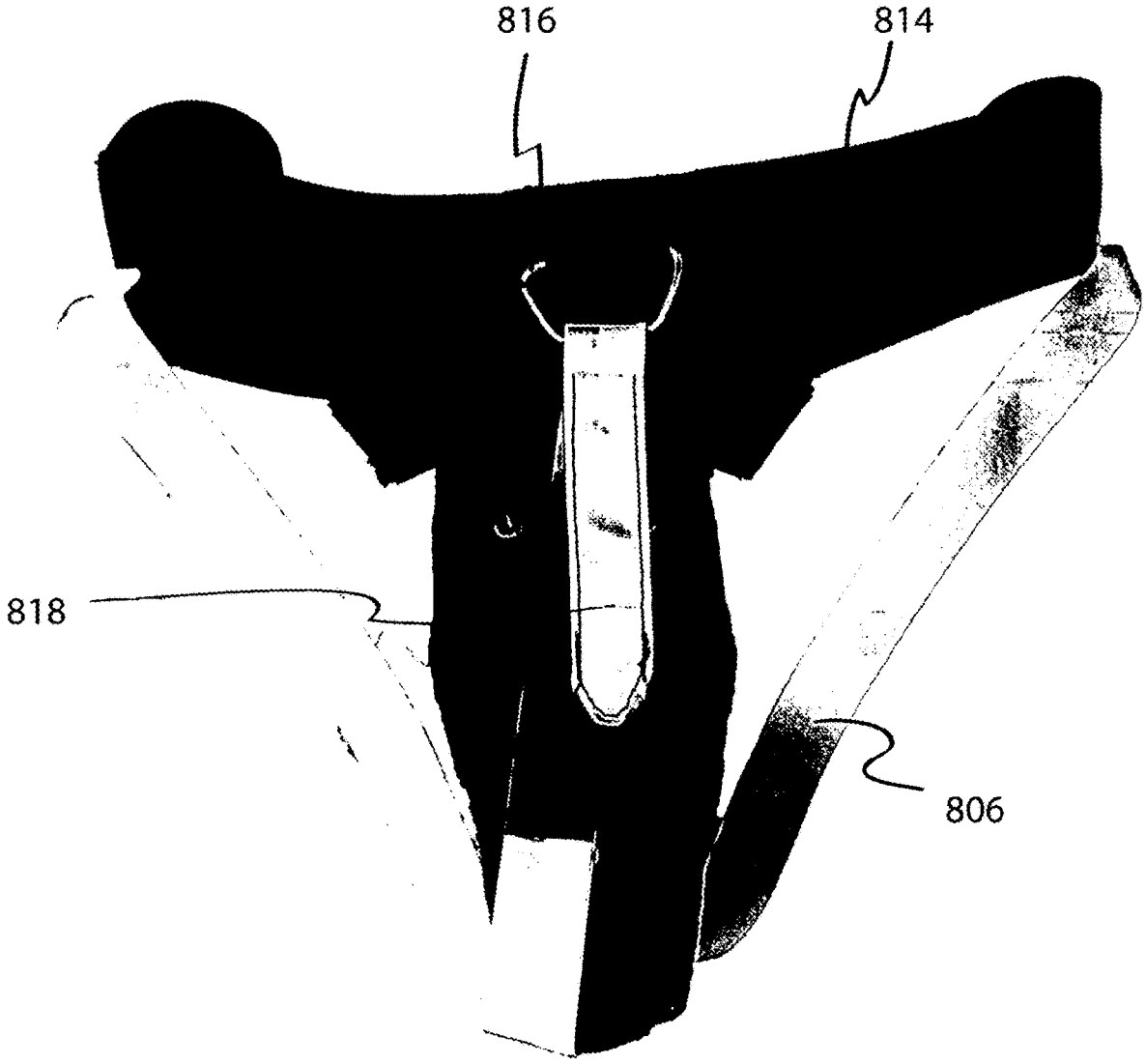
FIG. 8*c* illustrates a rear plan view of an assembled multi-directional flexible dynamically adjustable protection apparatus, according to one embodiment of the present teachings.
Figure 8D:
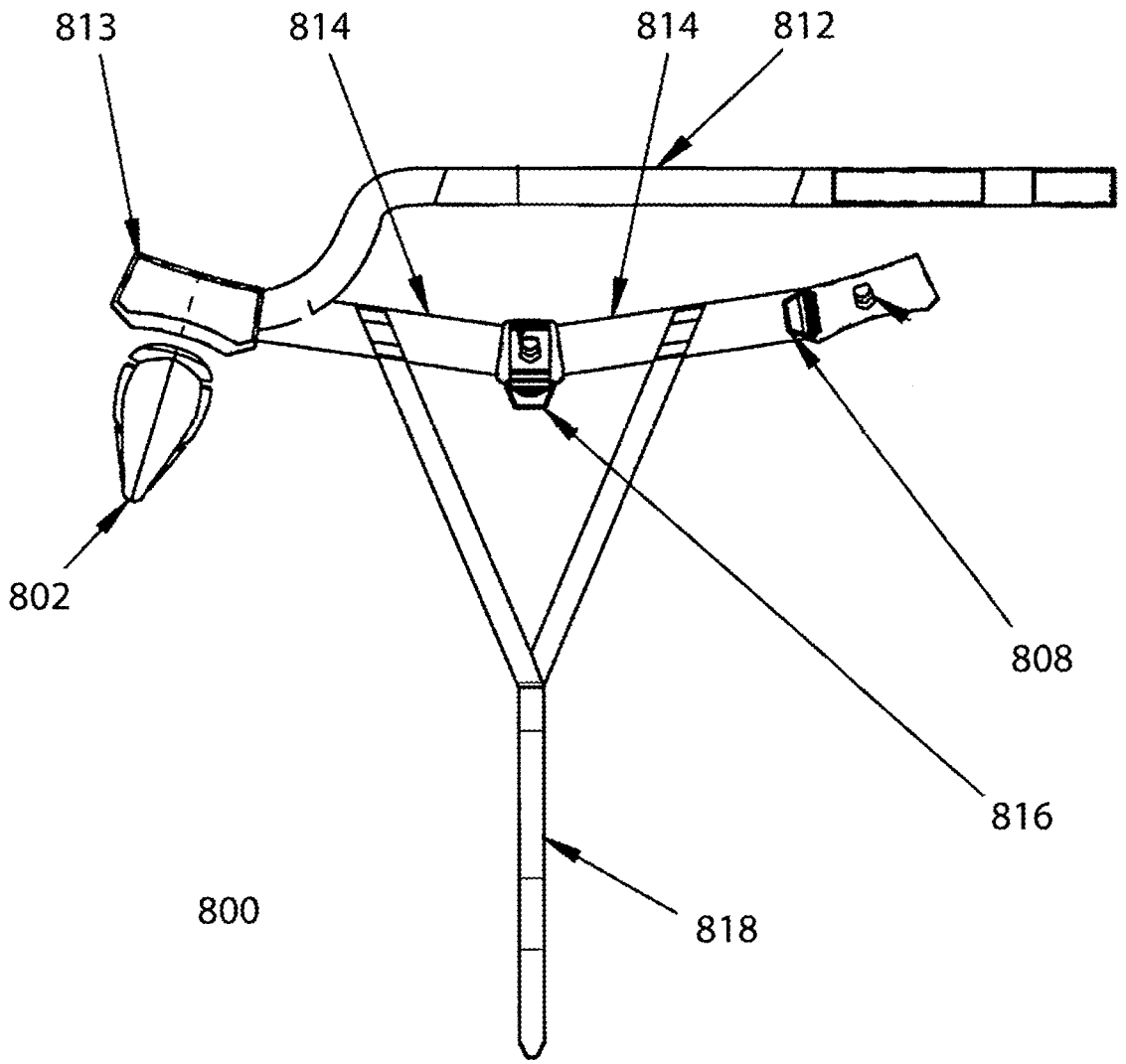
FIG. 8*d* illustrates a rear plan view of an assembled multi-directional flexible dynamically adjustable protection apparatus, according to one embodiment of the present teachings.

Referring now generally to FIG. 8*a*, FIG. 8*b*, FIG. 8*c*, and FIG. 8*d*, a multi-directional flexible dynamically adjustable protection apparatus 800 is illustrated. FIG. 8*a* illustrates a front view of a fully assembled multi-directional flexible dynamically adjustable protection apparatus 800. FIG. 8*b* illustrates a front view of a disassembled multi-directional flexible dynamically adjustable protection apparatus 800. FIG. 8*c* and FIG. 8*d* illustrate a rear view of a fully assembled multi-directional flexible dynamically adjustable protection apparatus 800.

In one embodiment, the multi-directional flexible dynamically adjustable protection apparatus 800 comprises a front affixing matching top portion 812, a front affixing matching bottom portion 813, a top cup plate 802, a flexible siding 804, a front strap clip loop 808, a waist strap 814, an abdomen protection portion 815, a hip strap 806, a rear strap clip loop 816, and a rear strap 818.

During sporting events, it is not always convenient to put on an athletic protective cup, because a user must remove clothing in order to put it on or to remove it. The presently disclosed multi-directional flexible dynamically adjustable protection apparatus 800 is configured such that a user may put it on without removing any clothing. Using a system of Velcro and straps, the multi-directional flexible dynamically adjustable protection apparatus 800 may be put on or removed by a user by merely pulling down partially the user's pants. That is, a user may disassemble the multi-directional flexible dynamically adjustable protection apparatus 800, as shown in FIG. 8*b*, pull down his/her pants by about six inches to a foot, fit the top cup plate 802 over the user's crotch, wrap the waist strap 814 about the user's waist, affix the front affixing matching top portion 812 onto the front affixing bottom portion 813 via the Velcro disposed upon each the reciprocal surfaces, pull the rear strap 818 between the user's legs and upward to loop around the rear strap clip loop 816 and affixing the rear strap 818 in place with another Velcro affixing portion. The user then may tighten the waist strap 814 to a desired tension by pulling the waist strap 814 through the front strap clip loop 808. The multi-directional flexible dynamically adjustable protection apparatus 800 is advantageous over currently available athletic protective cups, because a user may quickly and easily put in on without removing any clothing, which may be convenient if a user is on an athletic field and desires to quickly administer crotch protection. Moreover, if the user requires adjustments to be made quickly, adjusting the system of straps described is quick and effective and does not require the removal of clothing.

In one embodiment, the front strap clip loop 808 and/or the rear strap clip loop 816 are composed of bent metal rod connectors for the pull points, which provide a low profile and high degree of strength and longevity.

In one embodiment, the front strap clip loop 808 and/or the rear strap clip loop 816 are composed of fabric for the pull points, which provide a low profile and high degree of strength and longevity. This embodiment provides additional degrees of protection for athletes, which may require soft pull points for additional physical safety, and/or sporting regulations. Such fabric pull points may be composed of materials comprising, inter alia, cotton, polyester, rayon, lycra, mixed blend fabrics, and the like. It will be appreciated that all embodiments disclosed by the present teachings may include this fabric variation without departing from the scope and spirit of the invention.

In order to provide accuracy of placement, the multi-directional flexible dynamically adjustable protection apparatus 800 is configured such that the front affixing matching bottom portion 813 and the front affixing top portion 812 are color coded such that when affixed together, if there is any misalignment, it is immediately apparent, because the front affixing matching bottom portion 813 color is contrasted from the front affixing matching top portion 812. In one exemplary embodiment, illustrated in FIG. 8*b*, the front affixing matching bottom portion 813 is white, whereas the front affixing matching top portion is black. Therefore, when a user attempts to affix the top and bottom portions, if there is any misalignment the white color of the bottom portion will be immediately apparent and the user can readily realign the top and bottom portions. This is an important and useful aspect of the design, because any misalignment could lead to instability when an impact occurs.

The multi-directional flexible dynamically adjustable protection apparatus 800 is further advantageous over current state of the art solutions, because the flexible siding 804 functions to soften any physical contact between the multi-directional flexible dynamically adjustable protection apparatus 800 and the inner thigh of the user. The flexible siding 804 is composed of soft, breathable material, which allows the user a greater range of motion during sporting endeavors.

Another advantageous feature of the multi-directional flexible dynamically adjustable protection apparatus 800 is the abdomen protection portion 815, which functions to protect the lower abdomen of the user from a direct impact. This feature is distinguishable from current state of the art solutions for athletic protective cups, because currently available cups solely protect the user's genitals from impact, whereas the multi-directional flexible dynamically adjustable protection apparatus 800 of the present teachings provides a rigid plastic shielding above the genitals (i.e., the abdomen protection portion 815), covering and protecting the user's lower abdomen from physical impact during sporting endeavors.

In one embodiment, a soft cushion insert may be disposed between the top cup plate 802 and the user's body, such as for example a soft cushion similar to a gel shoe insert. In this configuration, the soft cushion insert will absorb and disburse energy from a physical impact, thereby providing the user with additional protection.

Figure 9A:
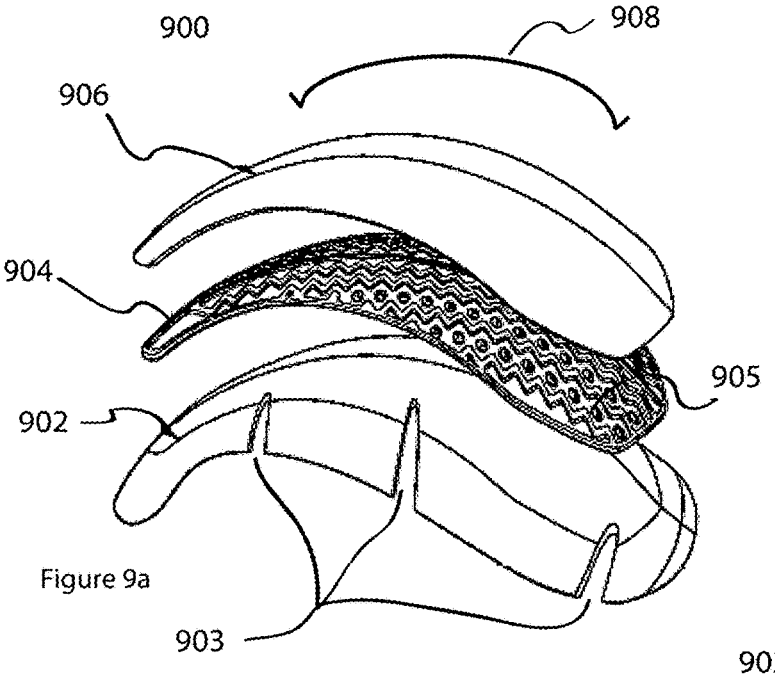
FIG. 9*a* is a disassembled view of a cup assembly for a multi-directional flexible dynamically adjustable protection apparatus, according to one embodiment of the present teachings.
Figure 9B:
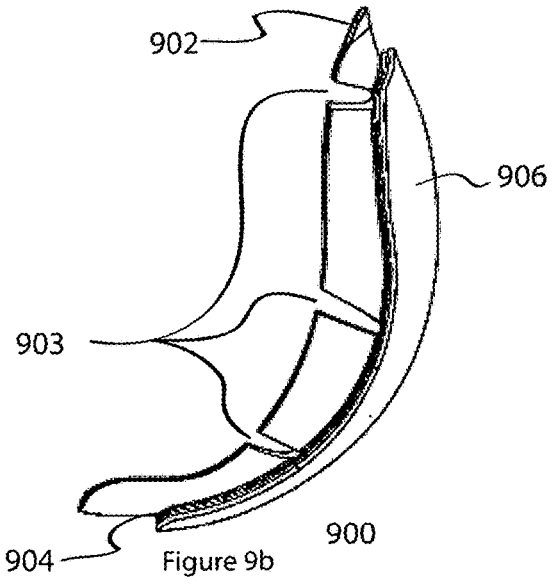
FIG. 9*b* is a side plan view of a cup assembly for a multi-directional flexible dynamically adjustable protection apparatus, according to one embodiment of the present teachings.
Figure 9C:
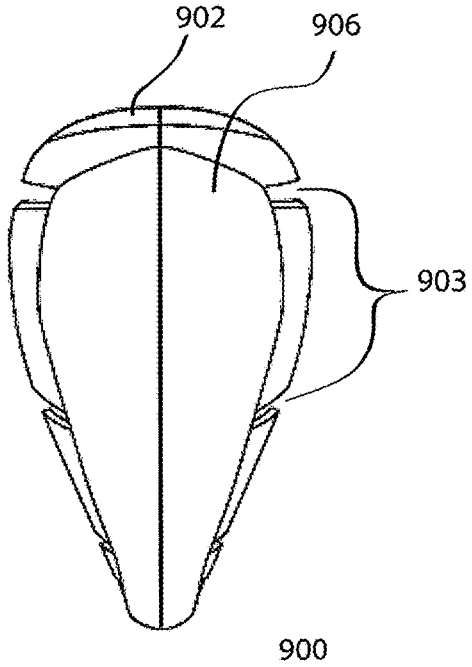
FIG. 9*c* is a top plan view of a cup assembly for a multi-directional flexible dynamically adjustable protection apparatus, according to one embodiment of the present teachings.

In one embodiment, as illustrated in FIG. 9*a* and FIG. 9*b*, and FIG. 9*c*, a cup assembly 900 for a multi-directional flexible dynamically adjustable protection apparatus is disclosed, comprising a primary cup element 902, a bridge layer 904, and an outer shield 906. The primary cup element 902 has flexibility along a lateral axis to provide comfort to a user during movement. That is, the primary cup element 902 has a plurality of lateral strain relief elements 903 disposed along the edges such that when a user is wearing the a cup assembly 900 for the multi-directional flexible dynamically adjustable protection apparatus, and moves laterally or vertically, the primary cup element 902 will not exert mechanical force upon the user's body, because the plurality of lateral strain relief elements 903 are designed to "stretch and compress". For example, if a user bends their torso to the left, with respect to the user's legs, the plurality of lateral strain relief elements 903 along the left side will absorb the mechanical force by "compressing" in a manner which decreases the spacing in between each of the plurality of lateral strain relief elements 903. Simultaneously, along the right side of the primary cup element 902, mechanical force is further reduced upon the user's body, because the plurality of lateral strain relief elements 903 along the right side expand, or stretch, such that the spacing between each of the plurality of lateral strain relief elements 903 is increased. The plurality of lateral strain relief elements 903 overcomes a major problem in current state-of-the-art solutions, which do not simultaneously provide rigid mechanical protection from direct impact, while allowing for reduced, or eliminated stress on the user's body, because currently available solutions have no lateral flexibility. The bridge layer 904 has uniquely designed force deflection geometry, comprising a force deflecting ribbing 905 designed to deflect incoming force along a lateral axis, away from the center of the a cup assembly 900 for the multi-directional flexible dynamically adjustable protection apparatus. By deflecting the force away from the center, this provides additional protection for a user upon direct impact. In one embodiment, a spring clip element 908 functions to affix the primary cup element 902, the bridge layer 904 and the outer shield 906 together in a secure manner. It will be appreciated that the spring clip element 908 allows a user to interchangeably use different sizes and/or different strengths of the primary cup element 902, the bridge layer 904, and the outer shield 906 as required by a user. In another embodiment, the primary cup element 902, the bridge layer 904, and the outer shield 906 are fused together in a more permanent manner, such as for example heat fusing or gluing.

Referring now to FIG. 10*a*, FIG. 10*b*, and FIG. 10*c*, in one embodiment, various elements of a multi-directional flexible dynamically adjustable protection apparatus 1000 are shown. A front affixing portion 1002 having a plurality of symmetrical slits 1003 on both lateral sides to accommodate a right waist strap 1004 and a left waist strap 1006 there-through a respective one of the plurality of symmetrical slits 1003. FIG. 10*c* illustrates an exploded view of a cup assembly, comprising a primary cup element 1008, a bridge layer 904, and an outer shield 1012. In one embodiment, the outer shield 1012 may include a slit element 1014, as shown in FIG. 10*b*, which is generally composed of fabric, which is adapted to fit comfortably between the lower portion of the cup assembly, between the user's legs and extend behind the user such that a rear strap, disposed rearward of the right waist strap 1004 and the left waist strap 1006, may fit there-through the slit element 1014 and pulled upward behind the user and affixed to the belt.

Figure 10D:
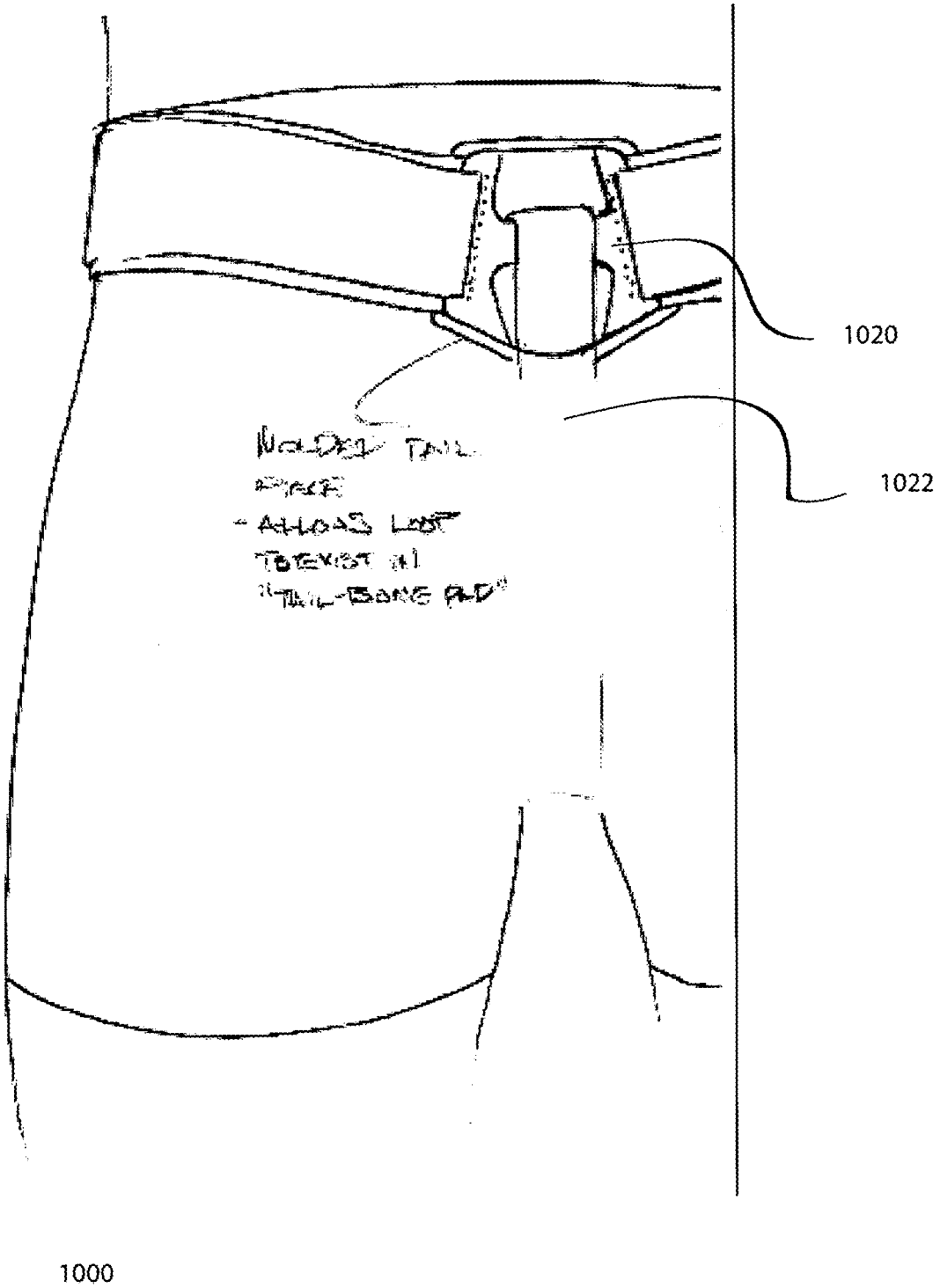
FIG. 10*d* shows a molded tail element intersecting with a plurality of straps of a belt assembly of a multi-directional flexible dynamically adjustable protection apparatus, according to one embodiment of the present teachings.

FIG. 10*d* illustrates a rear side of a user wearing a fully assembled multi-directional flexible dynamically adjustable protection apparatus 1000, comprising a molded tail element

1020 and a rear strap 1022. In this embodiment, the molded tail element 1020 is operatively coupled to both left and right straps, and engages the rear strap 1022 through a first and second aperture, as illustrated. The rear strap 1022 is then tightened into place by pulling the rear strap 1022 downward and securely affixed via Velcro. The molded tail element 1020 may also provide additional tailbone protection.

Figure 11A:
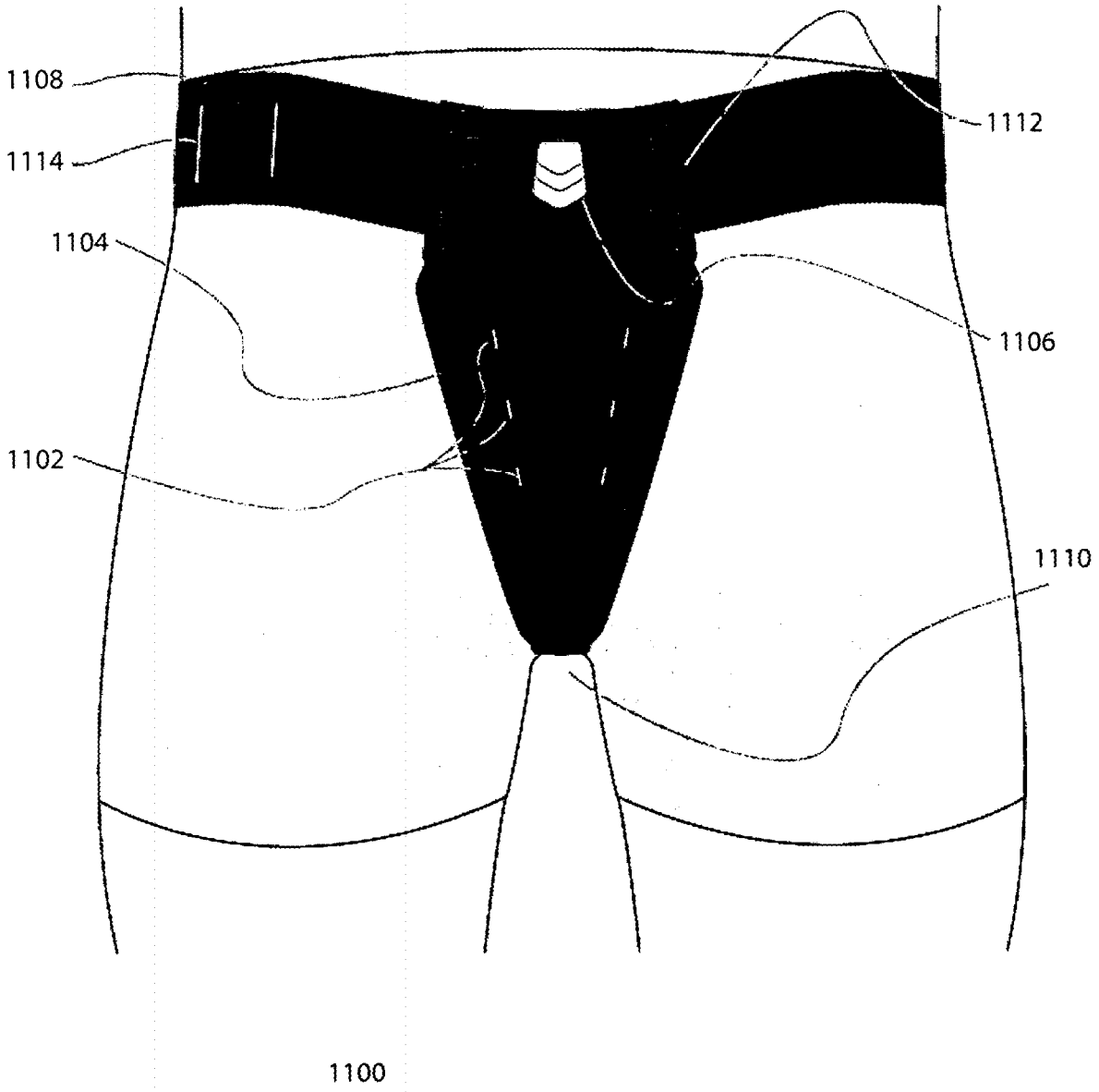
FIG. 11*a* illustrates a front view of a multi-directional flexible dynamically adjustable protection apparatus, according to one embodiment of the present teachings.
Figure 11B:
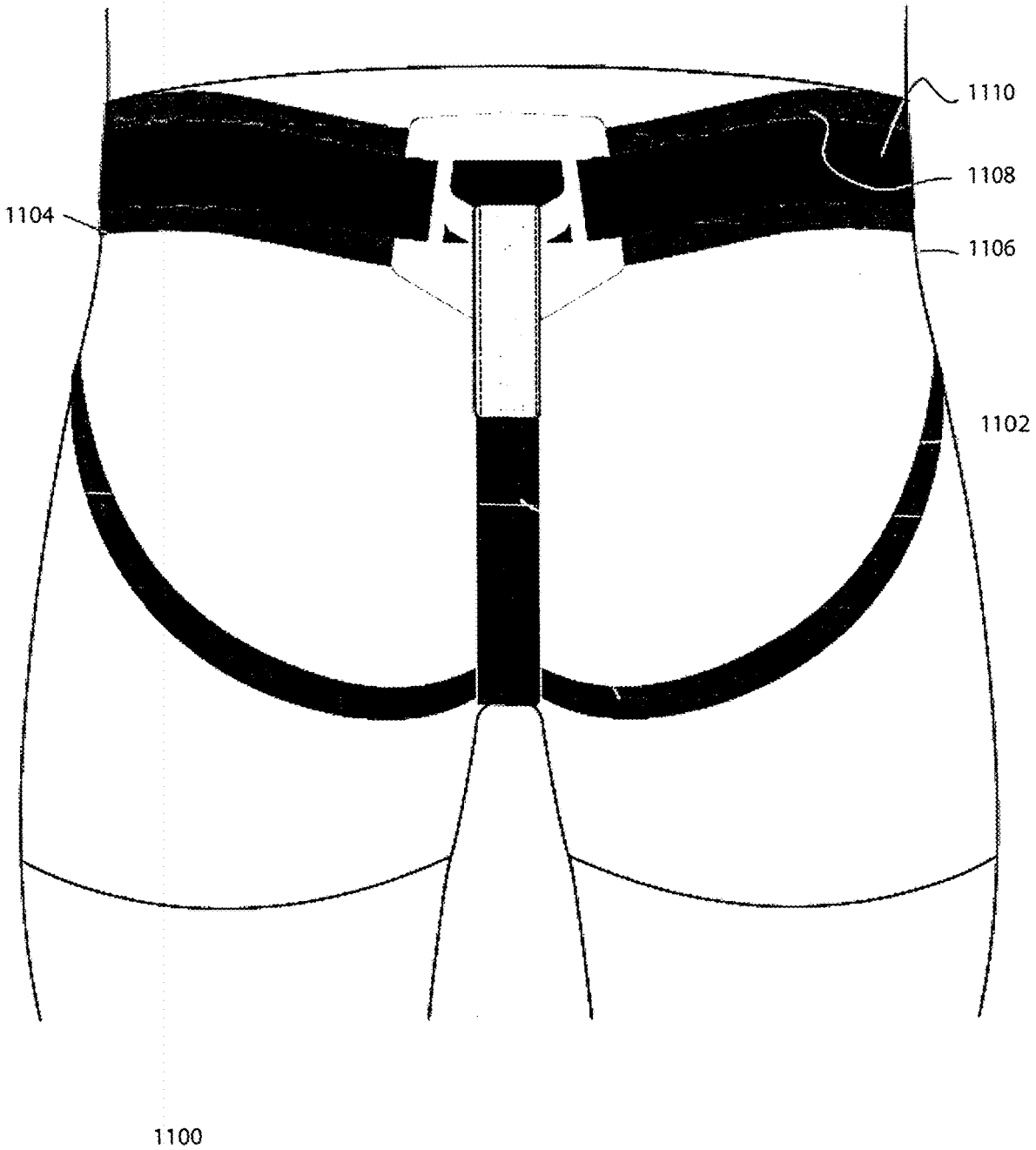
FIG. 11*b* illustrates a rear view of a multi-directional flexible dynamically adjustable protection apparatus, according to one embodiment of the present teachings.

FIG. 11*a* illustrates a front view of a multi-directional flexible dynamically adjustable protection apparatus 1100, comprising a plurality of lateral strain relief elements 1102, a cup assembly 1104, a front affixing portion 1106, a slit element 1110, and a belt assembly 1108. The belt assembly comprises a left strap 1112 and a right strap 1114. FIG. 11*b* illustrates a rear view of a multi-directional flexible dynamically adjustable protection apparatus 1100, comprising a rear strap 1102, a rear strap affixing element 1104, a molded tail element 1106, a belt assembly 1108 and a waist strap 1110. Operation of the various elements is similar to the descriptions above with respect to other embodiments.

The foregoing description illustrates exemplary implementations, and novel features, of aspects of a multi-directional flexible dynamically adjustable protection apparatus. Alternative implementations are suggested, but it is impractical to list all alternative implementations of the present teachings. Therefore, the scope of the presented disclosure should be determined only by reference to the appended claims, and should not be limited by features illustrated in the foregoing description except insofar as such limitation is recited in an appended claim.

While the above description has pointed out novel features of the present disclosure as applied to various embodiments, the skilled person will understand that various omissions, substitutions, permutations, and changes in the form and details of the present teachings illustrated may be made without departing from the scope of the present teachings.

Each practical and novel combination of the elements and alternatives described hereinabove, and each practical combination of equivalents to such elements, is contemplated as an embodiment of the present teachings. Because many more element combinations are contemplated as embodiments of the present teachings than can reasonably be explicitly enumerated herein, the scope of the present teachings is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. Furthermore, to the extent that the term "includes" is used in either the detailed description or the claims, such term is intended to be inclusive in a manner similar to the term "comprising".

What is claimed:

1. A multi-directional flexible dynamically adjustable protection apparatus for a user, comprising:

a cup assembly, comprising:

a primary cup element, having a concave first surface configured to be disposed immediately adjacent the user's body, wherein the primary cup element has a plurality of flexible peripheral strain relief elements disposed about a periphery of the primary cup element, and extending outward from the periphery, wherein the plurality of flexible peripheral strain relief elements operate for absorbing lateral mechanical strain when the user moves;

a bridge layer, coupled to a top portion of the primary cup element such that the primary cup element adapted to be disposed between the bridge layer and the user's body when worn, wherein the bridge layer comprises a force deflecting material, wherein the force deflecting material operates for absorbing a direct mechanical force and disperse the direct mechanical force laterally; and an outer shield, coupled to a top portion of the bridge layer, and adapted for absorbing direct mechanical force.

2. The apparatus of claim 1 including a belt assembly, comprising:

a front affixing portion, disposed vertically with respect to the cup assembly, wherein the front affixing portion comprises a left slit element, wherein the front affixing portion further comprises a right slit element, wherein the left slit element has a vertical height identical to a vertical height of a left strap such that the left strap laces through the left slit element, wherein the right slit element has a vertical height identical to a vertical height of a right strap such that the right strap laces through the right slit element, wherein the belt assembly further comprises a rear strap which laces through a molded tail element, and wherein the cup assembly is operatively coupled to the belt assembly such that the cup assembly is secured firmly to the user's body, wherein the user secures the cup assembly by dynamically adjusting the straps.

3. The multi-directional flexible dynamically adjustable protection apparatus for a user of claim 2 wherein the straps are dynamically adjustable with hook and loop fasteners.

4. The multi-directional flexible dynamically adjustable protection apparatus for a user of claim 1 wherein the primary cup element, the bridge layer, and the outer shield are mechanically affixed with glue.

5. The multi-directional flexible dynamically adjustable protection apparatus for a user of claim 1 wherein the primary cup element, the bridge layer, and the outer shield are mechanically affixed with a spring clip.

6. The apparatus of claim 1 wherein the force deflecting material has a ribbed configuration.

7. The apparatus of claim 1 wherein the primary cup element is resilient.

8. The apparatus of claim 1 wherein the bridge layer is elastomeric.

9. The apparatus of claim 1 wherein the bridge layer has an articulated surface.

10. The apparatus of claim 1 wherein the bridge layer has a textured surface.

11. The apparatus of claim 1 wherein the outer shield has a greater rigidity than the bridge layer and the primary cup element.

12. A multi-directional flexible dynamically adjustable protection apparatus for a user, comprising:

a cup assembly, comprising:

a primary cup element, having a concave first surface configured to be disposed immediately adjacent the user's body, wherein the primary cup element has a plurality of flexible peripheral strain relief elements disposed about a periphery of the primary cup element and extending outward from the periphery, wherein the plurality of flexible peripheral strain relief elements operate for absorbing lateral mechanical strain when the user moves;

a bridge layer, coupled to a top portion of the primary cup element such that the primary cup element adapted to be disposed between the bridge layer and the user's body when worn, wherein the bridge layer comprises an air bladder, wherein the air bladder operates for absorbing a direct mechanical force and disperse the direct mechanical force laterally; and an outer shield, coupled to a top portion of the bridge layer, and adapted for absorbing direct mechanical force.

13. The apparatus of claim 12 including a belt assembly, comprising:

a front affixing portion, disposed vertically with respect to the cup assembly, wherein the front affixing portion comprises a left slit element, wherein the front affixing portion further comprises a right slit element, wherein the left slit element has a vertical height identical to a vertical height of a left strap such that the left strap laces through the left slit element, wherein the right slit element has a vertical height identical to a vertical height of a right strap such that the right strap laces through the right slit element, wherein the belt assembly further comprises a rear strap which laces through a molded tail element, and wherein the cup assembly is operatively coupled to the belt assembly such that the cup assembly is secured firmly to the user's body, wherein the user secures the cup assembly by dynamically adjusting the straps.

* * * * *